United States Patent [19]

Huf

[11] 3,966,370

[45] June 29, 1976

[54] ROTARY PISTON MACHINE FOR TRANSPORTING LIQUID OR GASEOUS MEDIA

[75] Inventor: Franz Huf, Constance Germany

[73] Assignee: Dornier System GmbH, Germany

[22] Filed: Jan. 29, 1975

[21] Appl. No.: 545,185

[30] Foreign Application Priority Data

Feb. 5, 1974 Germany ..... 2405308

[52] U.S. Cl. ..... 418/183

[51] Int. Cl.[2] ..... F04C 29/08

[58] Field of Search ..... 418/183, 188

[56] References Cited

UNITED STATES PATENTS

| | | | |
|---|---|---|---|
| 3,883,273 | 5/1975 | King | 418/183 |

FOREIGN PATENTS OR APPLICATIONS

| | | | |
|---|---|---|---|
| 926,932 | 10/1947 | France | 418/183 |
| 1,551,123 | 10/1970 | Germany | 418/183 |

*Primary Examiner*—C. J. Husar
*Assistant Examiner*—Leonard Smith
*Attorney, Agent, or Firm*—James E. Bryan

[57] ABSTRACT

This invention relates to an improvement in a rotary piston machine of trochoidal construction for transporting a fluid medium, having working chambers formed between a trochoidal piston and a housing corresponding to the coordinated outer envelope curve, said chambers being separated from each other by radial seals in the housing, wherein the medium is supplied through openings within the inner envelope curve in the housing side wall and in a recess in the piston and passes from the recess by way of control openings in the peripheral piston surface to the working chamber, and having outlet openings in the housing closed-off by check valves, the improvement comprising a. the piston has the form of a saddle-free epitrochoid 1:1, b. the supply openings in the housing side wall are in the area of the radial seals, c. the piston recess is in the front piston wall and extends over such a portion of the piston that during rotation, continuously at least one supply opening and, in the dead-center position of the piston, both diametrically opposed supply openings are in communication with said recess, and d. in the dead-center position of the piston, the control openings are positioned immediately ahead of one radial seal shortly prior to the passage of said openings from the suction side to the pressure side.

12 Claims, 7 Drawing Figures

ROTARY PISTON MACHINE FOR TRANSPORTING LIQUID OR GASEOUS MEDIA

The present invention relates to a rotary piston machine of trochoidal construction for transporting liquid or gaseous media. Presupposed in this connection is a rotary piston machine whose piston shape corresponds to a trochoid, and whose housing profile is patterned after the coordinated outer envelope curve to the trochoid. Formed between the trochoid and the envelope curve are the working chambers of the machine. The individual working chambers are separated from each other by radial seals in the housing.

Known from German Offenlegungsschrift No. 1,551,123, is a rotary piston machine of the aforementioned construction, which serves for transporting liquid or gaseous media. The suctioning-in of the medium, and the delivery thereof to the working chambers takes place from a collecting chamber positioned in the housing side wall by way of suction ports or intakes in the front piston wall from which ports channels lead to openings or ports in the peripheral piston surface. From the openings or ports, the medium passes into the working chambers. The delivery into the pressure space or chamber is effected by way of check valves in the housing of the machine.

This known construction is unsatisfactory, however. Since the piston shape chosen is an epitrochoid 2:1 (reniform curve), disadvantages will result in view of the fact that, in the construction of simple control openings or ports extending under the radial seals, it is not possible to make use of the entire working chamber and stroke volume available on the basis of the geometrical structural conditions. One third of a working cycle remains unutilized. The proposal of providing the control openings or ports with check valves is likewise unsatisfactory since the valves within the piston are subjected to centrifugal force due to piston rotation. The centrifugal force acts therein counter to the valve effect sought. It is an aggravating factor that, because of the trochoidal movement, the instantaneous circumferential speed at the piston is subject to changes at all times and, as a result, also the continuously changing centrifugal force acts adversely upon the valves. Further difficulties are produced by the provision of the collecting chamber in the housing side wall because, in view of the trochoidal movement of the suction opening or port in the piston, the collecting chamber must have a special contour. The eccentric shaft of the machine must be provided in an overhung position on the side of the collecting chamber in order that room be provided in the housing side wall for the collecting chamber. Specific measures must be taken with regard to the oil seal.

Starting from the state of the art as described hereinabove, it is the object of the present invention to avoid the disadvantages of the prior art construction and to provide a rotary piston machine for transporting liquid or gaseous media which allows for as complete as possible a use over one working cycle without loss of working space, and which does not need any valves on the suction side; i.e., it is intended that the machine be usable over the greatest possible range of angular degrees of the crankshaft rotation. Particularly, a flying or overhung position of the eccentric shaft is to be avoided.

This object is obtained, in accordance with the present invention, by virtue of the fact that a. the piston is patterned after the form of a saddle-free epitrochoid 1:1;

b. the supply openings or ports are positioned in the housing side wall in the area of the radial seals;

c. the piston recess positioned in the front piston wall extends over a portion of the piston such that, during rotation, continuously at least one supply opening and, in the dead-center position of the piston, both of the mutually oppositely-positioned supply openings are in connection with the recess, and d. in the dead-center position of the piston, the control openings or ports are positioned immediately ahead of one radial seal shortly prior to the passage of the openings from the suction side to the pressure side.

Due to the choice of the epitrochoid 1:1, a complete utilization of the working cycle is practically obtained. Only a few degrees of the crankshaft rotation are lost. What is involved in this case is practically only the width of the control openings or ports in the piston. The width of the control openings or ports, however, may be maintained small since a greater number of openings or ports may be distributed over the piston width itself. No difficulties are involved in positioning the supply or feed openings or ports at the desired place in the housing side wall. The collecting chamber need not have a specific shape anymore. Moreover, a flying or overhung position, with the disadvantages thereof, is no longer necessary. Furthermore, there exists a great amount of freedom in regard to the connection of the supply openings with respect to each other; the same is true in regard to the cross-section of the supply openings. Essential in this connection is only that at least one supply opening at all times be in operative connection with the recess within the piston. The piston itself has a large side cavity. As a result thereof, it is considerably lighter and possesses a good cooling by the working medium. Within the large piston cavity and in the piston recess, a relatively large mass of the medium to be transported is present at all times in the piston, and, under the influence of the piston rotation, this mass may be better supplied to the working spaces or chambers through the control openings or ports because of centrifugal force. As a result thereof, a supercharging effect arises.

The supply of the medium to the piston also may be effected from both housing sides. This is possible particularly when it is not a direct gear follower system that is employed but instead other possible follower gears.

A further gain of utilizable angular degrees of the crankshaft is obtained for compressors by making use of the return expansion arising at the outlet valves, in that, according to a further embodiment of the present invention, trough-shaped recesses are on the peripheral piston surface, which recesses are positioned diametrically opposite the control openings or ports, and in the dead-center position of the piston are situated immediately ahead of the other radial seal. As soon as the recesses come to be located under the radial seal, they for a short period of time constitute a connection between the two working chambers. The high pressure at the outlet valve of one working chamber may now be compensated for at least partially and results in a certain charge of the other working chamber on the suction side. At that time a relief takes place in the harmful space of the pressure side so that the suctioning-in operation may begin much earlier, i.e. after a few degrees of crankshaft rotation. In this connection it is particularly advantageous that the outlet openings with the outlet valve be positioned as closely as possible to the radial seal.

One embodiment of the present invention will now be further explained hereinbelow on the basis of and with reference to the accompanying drawings, wherein:

FIG. 1 schematically illustrates a rotary piston machine, with a piston in the form of an epitrochoid 1:1, in the dead-center position;

Figure 1:
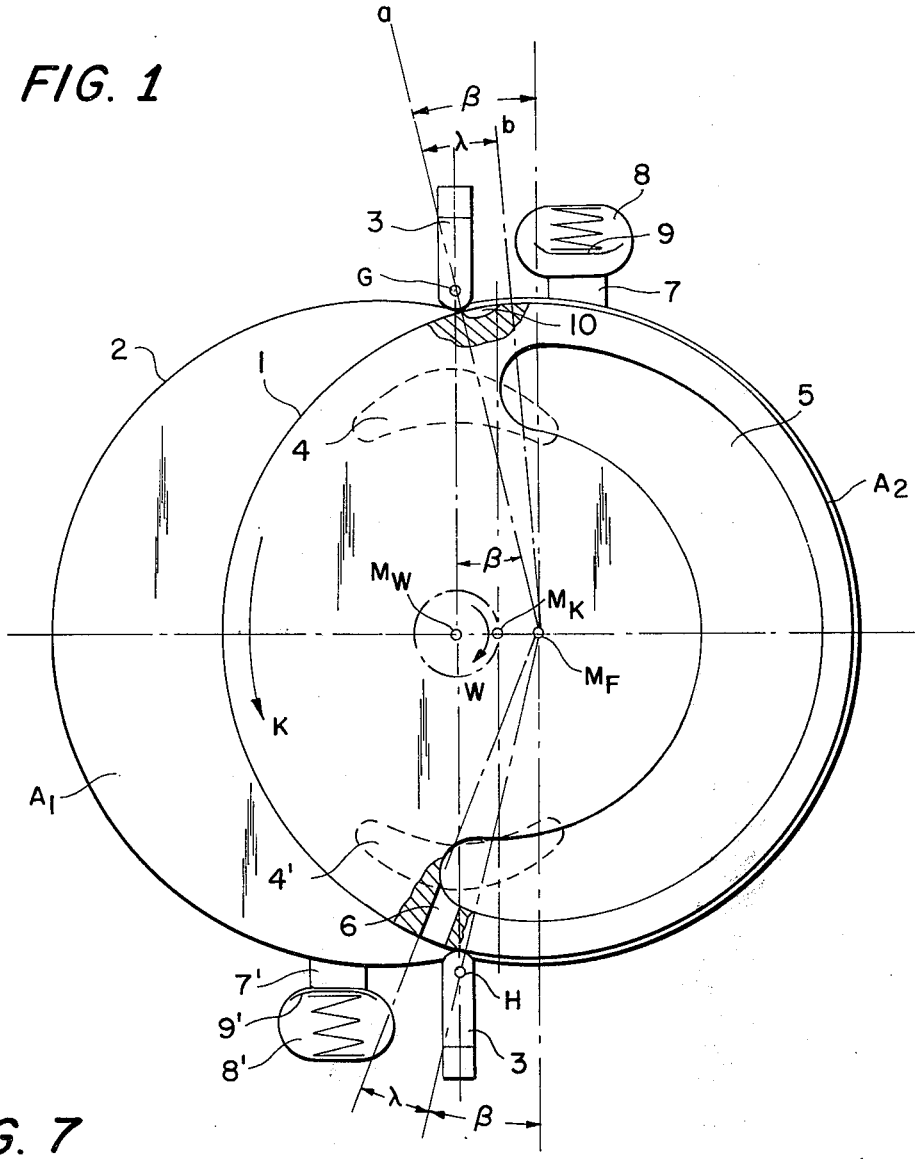

It is intended that the pure pumping effect be considered first on the basis of FIG. 1. This figure illustrates a piston 1 of the form of a saddle-free epitrochoid 1:1. The housing 2 is patterned after the outer envelope curve coordinated to this trochoid; it has been indicated only schematically. Reference numeral 3 defines the radial seals within the housing. Reference symbols G and H define the simultaneous points of the trochoid in which the curvature centers for the domes of the radial seals 3 are positioned. Within the piston 1 itself, its direction of rotation has been indicated by an arrow K. $M_W$ denotes the axle center of the drive shaft. Indicated in dash-dotted lines is the crank circle with the rotary arrow W. Within this crank circle moves the piston center $M_K$. $M_F$ designates the mathematical form center of the trochoid. The working chambers A1 and A2 are formed between the piston 1 and the housing 2. The piston 1 is positioned in the lower dead-center position with respect to the working chamber A1, and in the upper dead-center position with respect to the working chamber A2. In this position there occurs the maximum pivot angle $\beta$ at the radial seals 3. Provided in the housing 2 in proximity to the radial seals 3 are the outlet openings and the outlet valves. The outlet openings are identified with reference numerals 7 and 7'. These openings lead to the axial bores 8 and 8'. The outlet valves which are represented herein in a greatly simplified manner as check valves, are identified with reference numerals 9 and 9'. The outlet valve 9 is shown in the open condition since in the upper dead-center position of the piston the medium is fed from the working chamber A2 through this valve. In contrast thereto, the outlet valve 9' is closed on the suction side of the machine, i.e. momentarily in the working chamber A1.

Figure 4:
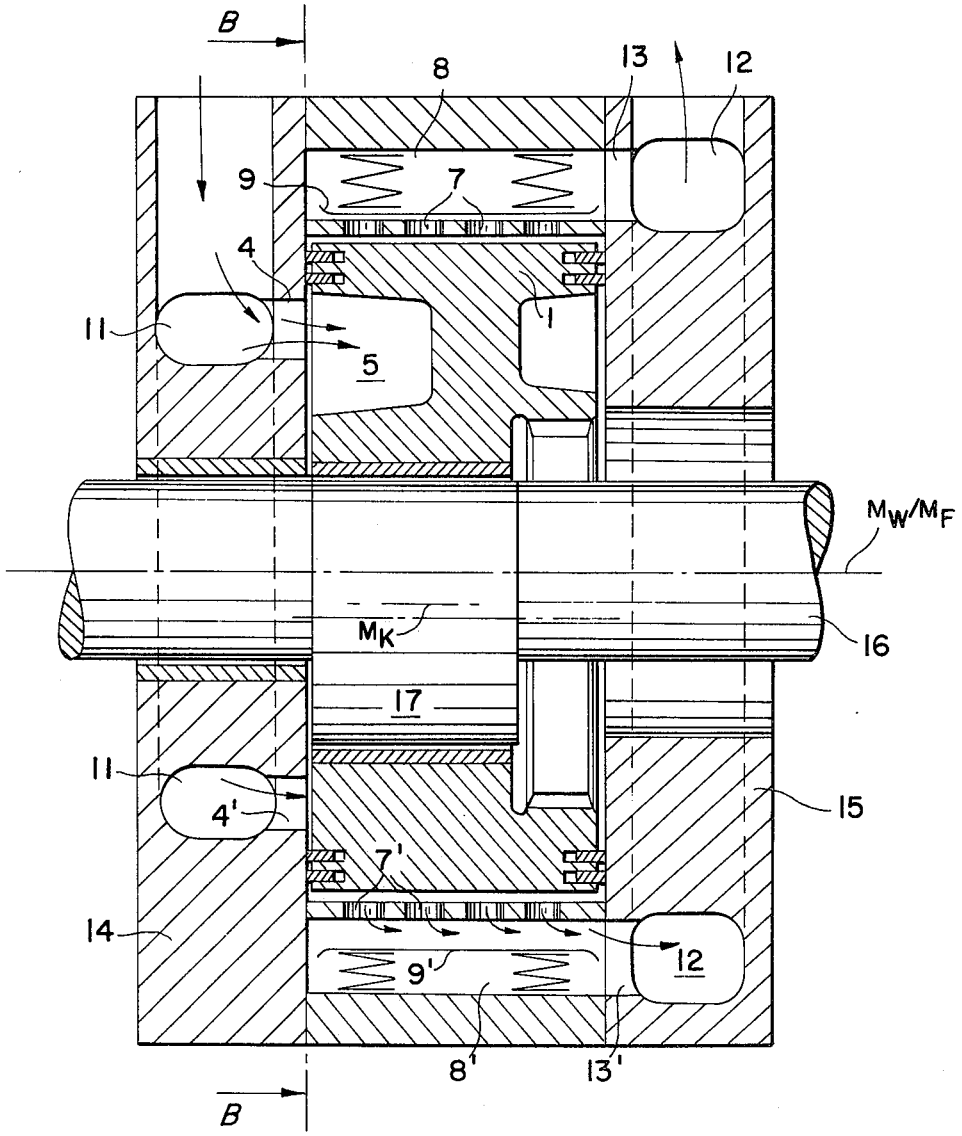
FIG. 4 represents an axial cross-section through FIG. 3.

As is apparent from FIGS. 1 and 4, feed or inlet openings 4 and 4' for the medium to be transported are positioned in the housing side wall 14. These inlet openings are arranged in each case within the zone or area of the radial seals 3. From these inlet openings 4 and 4' the working medium is adapted to enter into a piston recess 5 in a side wall of the piston 1. The recess within the piston has a shape such that, in the dead-center position of the piston represented in FIG. 1, it is in operative connection both with the inflow opening 4 and with the diametrically oppositely positioned inlet opening 4'. During rotation of the piston, one of the inlet openings 4 or 4' is at all times in operative connection with the piston recess 5. From the piston recess 5 there extend either one or several bores 6, as control openings or ports, to the peripheral piston surface. In the upper dead center position of the piston, the control opening or port 6 is located immediately ahead of the radial seal 3 with the simultaneous point H. At this instant there still thus exists a connection to the suction side A1. The angle between the simultaneous point H and the end of the control opening or port 6 has been defined with $\lambda$. The angle which approximately corresponds to one sealing strip width is advantageously smaller than the pivot angle $\beta$ at the radial seal. Positioned diametrically opposite to the control openings or ports 6 are the trough-shaped recesses 10 in the peripheral piston surface. Advantageously the angle $\lambda$ will occur also in these trough-shaped recesses 10. The limits of the angle $\lambda$ are represented by the lines *a* and *b*. In the case shown in FIG. 1, the working chamber A2 is contracted to a small gap. It is here that maximum compression takes place and the medium has been transported fully from out of this working chamber. On the other hand, the charge is completed on the suction side within the working chamber A1. Still a connection to the working chamber A1 on the suction side exists from the feed or inlet openings 4 and 4' by way of the piston recess 5 and the control opening or port 6.

Figure 2:
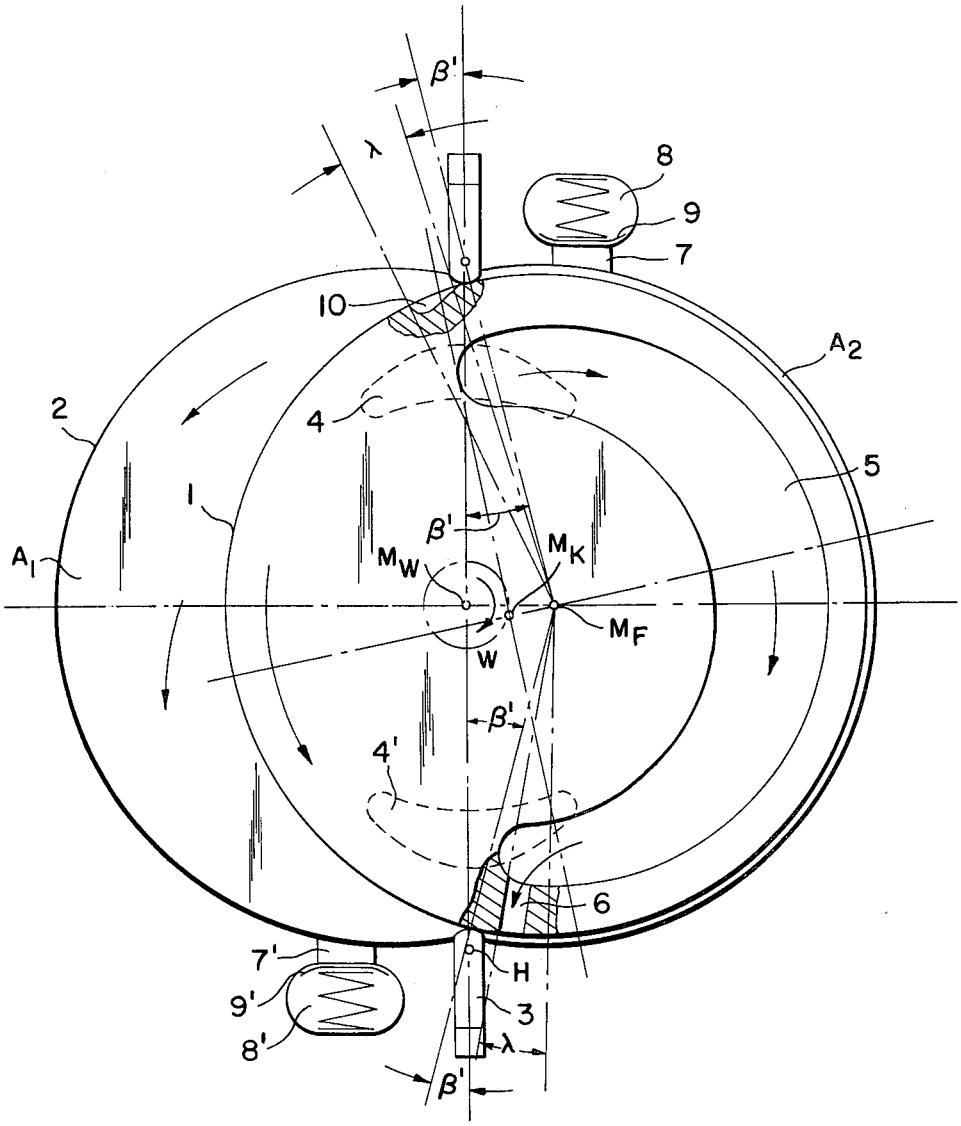
FIG. 2 is a change with respect to FIG. 1 in a manner such that the piston has been further rotated about a small angular amount.

As compared to FIG. 1, FIG. 2 illustrates the modification that the piston has been rotated out of its top dead-center position by a few degrees. At that time, the control openings or ports 6 have just slid past over the radial seal 3 at the simultaneous point H. Also the trough-shaped recess has passed under the radial seal 3. In both instances the angle $\lambda$ again has been shown and drawn in. The pivot angle has been changed due to the further movement of the piston and is now reduced to the momentary value $\beta'$. The working chamber A2 already has increased slightly in a sickle-shaped fashion. From the supply or inlet openings 4 and 4' by way of the piston recess 5 and the control openings or ports 6, fresh medium may enter into the working chamber A2; the charging of the working chamber has begun. The outlet valve 9 on the discharge side is closed. The working chamber A1, on the other hand, is completely closed by the two radial seals 3 so that here the supply or feed of the medium and also compression may begin. The supply direction for the medium has been indicated by the arrows in the working chamber A1. The last arrow terminates in the outlet bore 7'. The outlet or discharge valve 9' is still closed, yet during further rotation of the piston it will soon open under the pressure of the medium to be transported.

Figure 3:
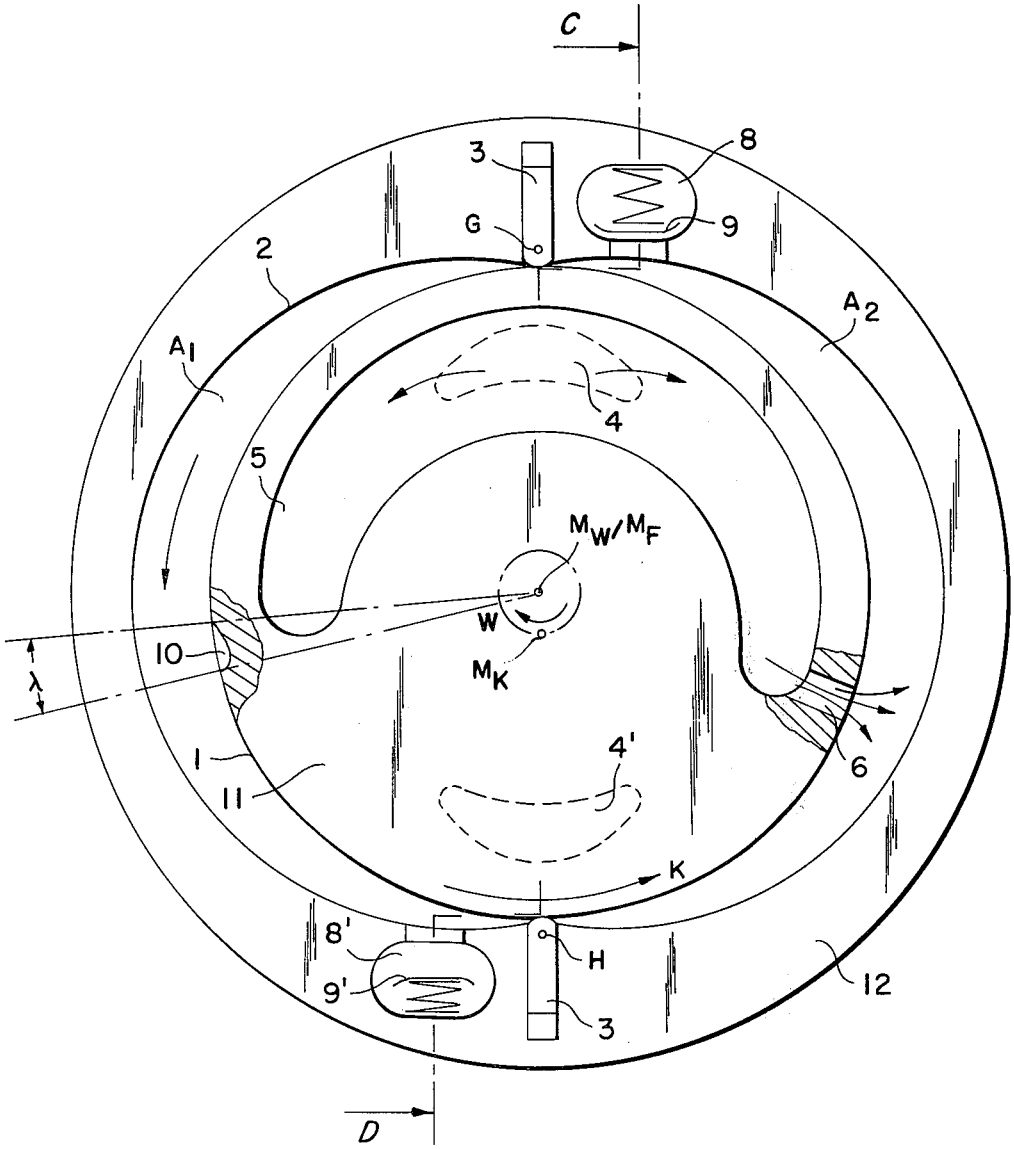
FIG. 3 shows the position of the piston after 90° of crankshaft rotation.

FIG. 3 illustrates the position of the piston during further rotation of the crankshaft by 90°. The medium is again guided from the supply opening or port 4 through the control openings 6 into the working chamber A2. The working chamber A2 has expanded and is being filled. Within the large space of the piston recess there is already present a relatively large mass of the medium, whereby — at the high speed of the machine as a result of the centrifugal force — the medium is better transported into the working chamber, hence a better charging is achieved. Thus produced, by virtue of the rotary movement of the control openings or ports 6, is a genuine layered charge by means of the centrifugally discharging medium. The outlet valve 9 in this working chamber remains closed. The working chamber A1, on the other hand, continues to feed since it is becoming smaller. The outlet valve 9' is open, and the medium is further transported along in the direction of the arrow via the axial bore 8' into an outlet collecting channel.

FIG. 4 shows an axial cross-sectional view taken along the line C–D of FIG. 3. Reference numeral 16 identifies the drive shaft. The fulcrum or pivot center of the machine again is identified herein with reference symbol $M_W$. At the distance of the machine eccentricity from the fulcrum or pivot point $M_W$ is the piston center $M_K$, indicated in dash-dotted lines. The drive shaft 16 carries an eccentric 17 whose center here coincides with the axis of the piston center $M_K$. The piston 1 is rotatably mounted on the eccentric 17. There is no need to describe in detail the follower gear system which is to force the trochoidal movement. Any known constructions for follower gear systems are possible.

The machine is closed-off by the side walls 14 and 15. Between these two side walls is the jacket 2 in which are the axial bores 8 and 8' for the outlet. In this case the axial bores 8 and 8' are in operative connection with the working chambers by way of the outlet bores 7 and 7'. Arranged within the axial bores are the outlet valves 9 and 9'. The medium transported through the outlet openings 7 in the axial bores 8 flows through the bores 13 and 13' in the side wall 15 into an outlet collecting channel 12. This outlet collecting channel 12 may have any desired shape. Here it is shown as an annular channel. This construction has been indicated in dash-dotted lines in FIG. 3. The supply of the medium to be transported takes place in the embodiment shown through a supply channel 11 in the side wall 14. The configuration of this channel also may be as desired. In the present case, the form of an annular channel 11 again is chosen; it also has been indicated in FIG. 3 in dash-dotted lines. From this annular channel 11 extend the supply openings 4 and 4' to the piston recess 5. The supply direction of the medium is indicated by arrows. Because of the large recess 5 in the piston, the piston itself is very light and is well cooled by the medium flowing therethrough. Further indicated in the piston 1 are axial seals, but it is not necessary to refer thereto in any detail. They ensure complete sealing of the working chambers.

The construction of the side wall 14 with its annular channel 11 is very simple. In this manner it is possible to position the drive shaft 16 in the side wall 14. Accordingly, the adverse overhung or flying positioning of the heretofore known arrangements is avoided thereby. As has been mentioned hereinabove, the two annular channels 11 and 12 for the supply and discharge of the medium may be accommodated jointly in the same side part, for example in the side part 14. They then would be positioned concentrically within each other. No structural difficulties arise in this case. On the other hand, it is also possible to provide the supply channels 11 with the supply or inflow openings 4 and 4' or exhaust or discharge channels 12 with the discharge bores 13 and 13' in each case in both side parts 14 and 15. In this case the piston 1 carries the aforementioned piston recesses 5 on both sides.

Figure 5:
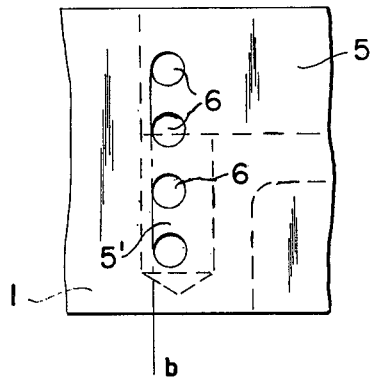
FIG. 5 is a section at an enlarged scale from the peripheral piston surface with the provision of the control openings or ports.

FIG. 5 represents a section or portion from the surface of the piston 1. The piston recess 5 is shown therein in dash-dotted lines. At the end of this recess is an axial bore 5' so that several control openings or ports 6 may be provided over the depth of the recess 5 and the depth of the bore 5'. The end of the control openings 6 has been indicated by the line *b* — viewed in the direction of rotation of the piston. In this embodiment it has been assumed that a piston recess 5 is provided on one piston side only. On the other piston side, one piston cavity has been indicated merely for the purpose of eliminating weight. However, as is easily apparent, this recess also may be so provided that it is in operative connection with the control openings or ports 6 and has the same function as the piston recess 5 on the other side of the piston.

While hereinbefore essentially the pumping or feeding effect has been considered in this embodiment, the compressor operation will now be dealt with. The known problem of the return expansion arises in this connection, such as becomes apparent in a very adverse fashion in lifting cylinder compressors. In the harmful space of the compressor, i.e. within the greatly narrowed working chamber of the pressure side, inclusive of the outlet openings in proximity to the valve, there prevails a high pressure on the pressure side which must first expand, during further rotation of the machine, before in the increasing working chamber an underpressure will exist sufficient for the suctioning-in of a renewed charge. With the use of uncontrolled valves, these valves open very late due to the return expansion. The delay due to return expansion is 20 and more degrees of crankshaft rotation after the deadcenter position. This factor represents a considerable loss of usable stroke volume and volumetric efficiency.

Figure 6:
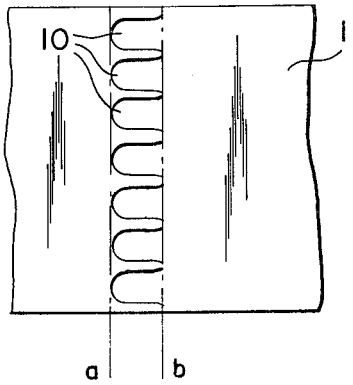
FIG. 6 is a section at an enlarged scale from the peripheral piston surface with the provision of the recesses.

As already has been set forth in connection with FIG. 1, trough-shaped recesses 10 are positioned diametrically opposite to the control openings or ports 6 on the peripheral piston surface. In the top dead-center position of the piston 1 shown in FIG. 1, the trough-shaped recess 10 begins at line *a*, i.e. at the line of contact of the radial seal 3 with the peripheral piston surface. The end of the trough-shaped recess 10 is located at line *b*. The length of the trough 10 therefore corresponds to the angle $\lambda$. The trough-shaped recesses 10 advantageously have a greater curvature at the leading end thereof than at the trailing end thereof. This configuration is favorable for the flow-through operation which will be further described hereinbelow. The arrangement of several trough-shaped recesses 10 has been shown in FIG. 6. Apparent therefrom is a section of the peripheral surface of the piston 1, wherein the trough-shaped recesses begin with the line *a* and end with line *b*.

Figure 7:
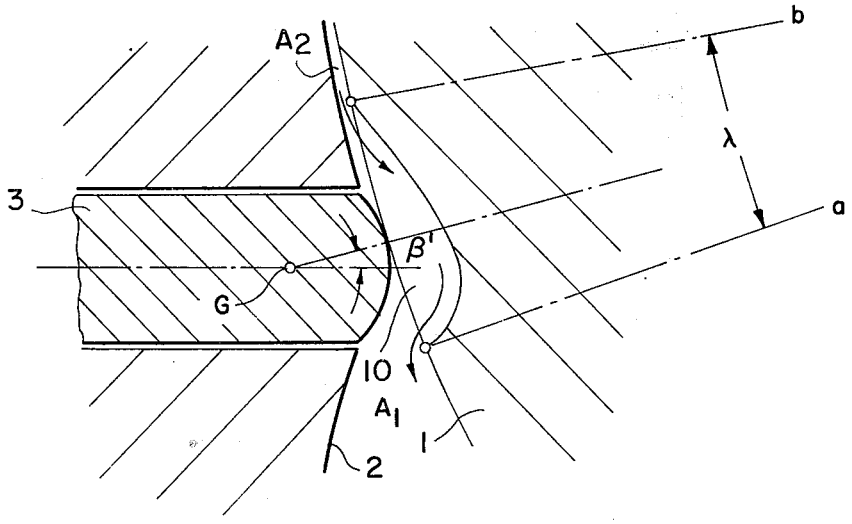
FIG. 7 is a section at an enlarged scale from the area of the radial seal.

The operation of these trough-shaped recesses 10 will be further explained herein with reference to FIG. 7. Shown in this figure is the position of the piston a very short time before leaving the top dead-center position. After a few degrees of crankshaft rotation, a trough-shaped recess 10 will be positioned just under the radial seal 3. The pivot angle has in this case the instantaneous value $\beta'$. The working chamber A2 is still a narrow gap between the surface of the piston 1 and the jacket 2. It corresponds almost to the expansion in the top dead-center position. The working chamber A1 is still very wide and still corresponds practically to its volume in the bottom dead-center position. In the harmful space of the working chamber A2, i.e. on the pressure side within the narrow gap between the piston and the jacket as well as in the outlet bore 7 to the valve 9, there still prevails a high pressure of the compressed medium. In the working chamber A1, on the other hand, there still exists the pressure of the suctioned-in medium. Through the trough-shaped recesses 10, a portion of the medium having a high pressure now can flow over into the working chamber A1. As a result thereof, the high pressure in the harmful space is rapidly reduced on the pressure side. No portion of the medium is lost, however; rather, the transferred medium will additionally be added as a supercharging portion to the normal filling or charge within the working chamber A1. The delimiting or boundary lines *a* and *b* of the trough-shaped recess 10 have been indicated, as well as the angle λ. The angle λ advantageously corresponds to those angular degrees which are required in order to — starting from FIG. 1 — rotate the control openings or ports 6 completely past under the radial seal 3 so that the working chambers are again completely sealed. In this time the filling or charge within the working chamber A1 is completed.

The shape and size of the trough-shaped recess 10 may be accommodated to the other operating conditions of the macine, i.e. to speed, extent of the return expansion and the like. For the utilization of the return expansion it is very advantageous that — as has been set forth already hereinabove — the harmful spaces be positioned as closely as possible to the radial seal of the descending side. It is for this reason that the discharge openings 7 and 7' are provided in immediate proximity to the radial seals 3 in the jacket 2. Required as a result thereof are only short flow paths from this harmful space through the trough-shaped recesses 10 to the other working chamber. The pressure compensation takes place rapidly and completely. Due to the curved shape of the trough-shaped recesses, a good flow-over is achieved in the direction indicated by the arrows in FIG. 7.

It will be obvious to those skilled in the art that many modifications may be made within the scope of the present invention without departing from the spirit thereof, and the invention includes all such modifications.

What is claimed is:

1. In a rotary piston machine of trochoidal construction for transporting a fluid medium, having working chambers formed between a trochoidal piston and a housing corresponding to the coordinated outer envelope curve, said chambers being separated from each other by radial seals in the housing, wherein the medium is supplied through openings within the inner envelope curve in the housing side wall and in a recess in the piston and passes from the recess by way of control openings in the peripheral piston surface to the working chamber, and having outlet openings in the housing closed-off by check valves, the improvement comprising a. the piston has the form of a saddle-free epitrochoid 1:1, b. the supply openings in the housing side wall are diametrically opposed and in the area of the radial seals, c. the piston recess is in the front piston wall and extends over such a portion of the piston that during rotation, continuously at least one supply opening and, in the dead-center position of the piston, both diametrically opposed supply openings are in communication with said recess, and d. in the dead-center position of the piston, the control openings are positioned immediately ahead of one radial seal shortly prior to the passage of said openings from the suction side to the pressure side.

2. A rotary piston machine according to claim 1 in which, in the dead-center position of the piston, the angular distance of rotation of the control openings to the radial seal is smaller than the momentary pivot angle at the radial seal.

3. A rotary piston machine according to claim 1 in which the outlet openings, viewed in the direction of rotation of the piston, are positioned in the area ahead of the radial seal.

4. A rotary piston machine according to claim 1 in which the supply openings are connected with each other by a channel in a housing side wall.

5. A rotary piston machine according to claim 1 in which the outlet openings terminate in axial bores in the housing, and said bores terminate in a collecting channel in a housing side wall.

6. A rotary piston machine according to claim 1 including supply openings in both housing side walls.

7. A rotary piston machine according to claim 1 including a supply channel in one housing side wall and an outlet collecting channel in the other housing side wall.

8. A rotary piston machine according to claim 1 including a supply channel and an outlet collecting channel concentrically positioned in one housing side wall.

9. A rotary piston machine according to claim 1 including trough-shaped recesses on the peripheral piston surface, said recesses being positioned diametrically opposite the control openings, and, in the dead-center position of the piston, immediately ahead of a radial seal.

10. A rotary piston machine according to claim 9 in which, in the dead-center position of the piston, the beginning of the trough-shaped recesses is positioned at the line of contact of the radial seal with the peripheral piston surface.

11. A rotary piston machine according to claim 9 in which the length of the trough-shaped recesses corresponds to the angular degrees of rotation required for the control openings to pass under the radial seal from the dead-center position of the piston.

12. A rotary piston machine according to claim 9 in which the trough-shaped recesses are more markedly curved at the leading end thereof than at the trailing end thereof.

* * * * *